US006122800A

United States Patent [19]

Cheng

[11] Patent Number: 6,122,800

[45] Date of Patent: Sep. 26, 2000

[54] EXPANDABLE PULL ROD OF LUGGAGE

[75] Inventor: Lee Tung Cheng, Taichung, Taiwan

[73] Assignee: Tu Cherng Le Enterprise

[21] Appl. No.: 09/097,358

[22] Filed: Jun. 15, 1998

[30] Foreign Application Priority Data

Aug. 9, 1997 [CN] China ..... 86213521

[51] Int. Cl.[7] ..... B65D 25/28; A45C 13/00

[52] U.S. Cl. ..... 16/113.1; 16/429; 16/114.1; 280/655; 280/47.26

[58] Field of Search ..... 16/405, 113.1, 16/429, 115; 280/655, 47.26, 655.1; 190/115, 39; 403/103, 104, 109.3, 109.2

[56] References Cited

U.S. PATENT DOCUMENTS

| | | | |
|---|---|---|---|
| 4,299,313 | 11/1981 | Null | 190/18 |
| 5,628,088 | 5/1997 | Chen | 16/115 |
| 5,636,410 | 6/1997 | Chou | 16/115 |
| 5,704,725 | 1/1998 | Horing | 403/109 |
| 5,836,052 | 11/1998 | Chou | 16/115 |
| 5,893,196 | 4/1999 | Tserng | 16/115 |
| 5,909,760 | 6/1999 | Tsai | 16/115 |
| 5,984,064 | 11/1999 | Byington | 190/115 |

*Primary Examiner*—Anthony Knight
*Assistant Examiner*—Robert L. Pilaud
*Attorney, Agent, or Firm*—W. Wayne Liauh

[57] ABSTRACT

A luggage pull rod has a hand grip which is provided with an adjustment device capable of actuating a locating device fastened with the bottom end of an inner tube. The inner tube is received extractably and retractably in an outer tube and is provided at the bottom end thereof with a locating hole which is engageable with a second locating portion of the locating device. The outer tube is provided therein with a locating element having a plurality of first locating holes engageable with the second locating portion of the locating device. The locating element is provided with a smooth portion devoid of the first locating portions.

6 Claims, 10 Drawing Sheets

EXPANDABLE PULL ROD OF LUGGAGE

FIELD OF THE INVENTION

The present invention relates generally to a luggage, and more particularly to an expandable pull rod of the luggage.

BACKGROUND OF THE INVENTION

As shown in FIGS. 1–3, a prior art luggage is provided with an expandable pull rod 11 to facilitate the pulling of the luggage. The pull rod 11 is provided with a locating device 12 and an adjustment device 13. The locating device 12 is composed of an inner tube 121 and an outer tube 123 fitted over the inner tube 121. The inner tube 121 is provided on the outer wall thereof with a protruded block 122, whereas the outer tube 123 is provided with a retaining slot 125 engageable with the protruded block 122 of the inner tube 121. The protruded block 122 is capable of being actuated by the adjustment device 13 to disengage the retaining slot 125 such that the inner tube 121 can be extracted or retracted in the outer tube 123. As soon as the adjustment device 13 is relieved of an external force exerting thereon, the protruded block 122 of the inner tube 121 is once again engaged with the retaining slot 125 so as to locate the inner tube 121. In other words, the pull rod 11 can be adjusted in length in accordance with the requirements of a user of the luggage. Located in proximity of the pull rod 11 is a receiving slot 14 to accommodate the inner tube 121 when the inner tube 121 is fully retracted into the outer tube 123.

The adjustment device 13 is located at a grip portion 111 of the pull rod 1. In order to retract the inner tube 121 fully into the outer tube 123, the adjustment device 13 must be pressed down by hand. In addition, the fingers of a user of the luggage are prone to be caught between the top edge of the luggage and the grip portion 111 at the time when the inner tube 121 is about to be fully retracted into the outer tube 123.

FIG. 3 shows an exploded view of another embodiment in which the retaining slots 125 are provided in an elongated plate 124, which is then inserted into the outer tube 123.

SUMMARY OF THE INVENTION

The primary objective of the present invention is therefore to provide a luggage with an improved pull rod free from the drawbacks of the luggage pull rod of the prior art described above.

The pull rod of the present invention is expandable and is composed of an inner tube, an outer tube, an adjustment device, and a locating device. The inner tube can be fully retracted into the outer tube without having to press the adjustment device with one hand. In addition, the outer tube is provided therein with the locating device capable of preventing the fingers of a user of the luggage from being caught between the top edge of the luggage and the grip portion of the inner tube at the time when the inner tube is about to be fully retracted into the outer tube.

The foregoing objective, features, functions, and advantages of the present invention will be more readily understood upon a thoughtful deliberation of the following detailed description of the present invention with reference to the accompanying drawings.

DETAILED DESCRIPTION OF THE INVENTION

Figure 1:
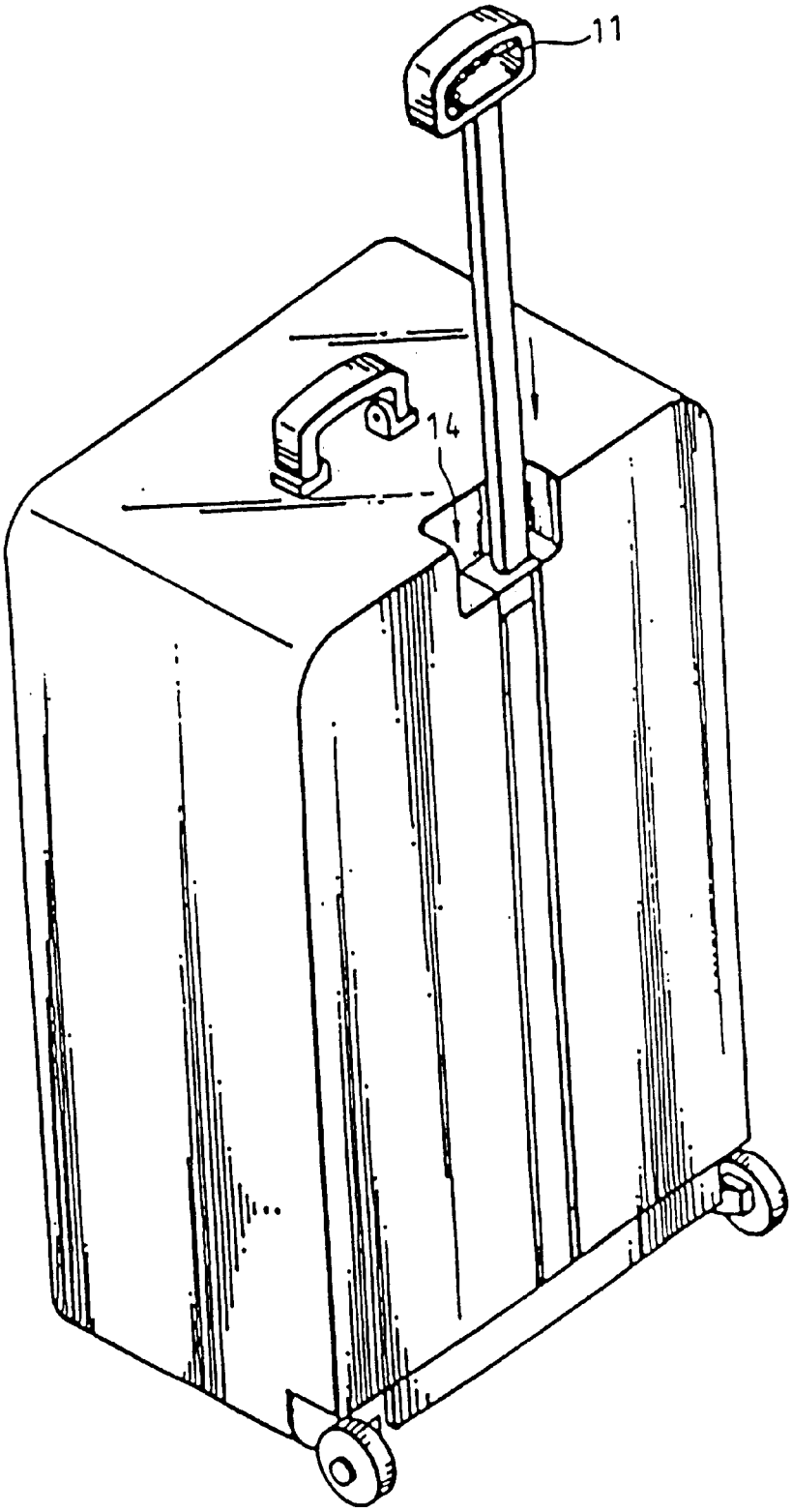
Fig · 1 PRIOR ART
FIG. 1 shows a perspective view of a prior art luggage.
Figure 2:
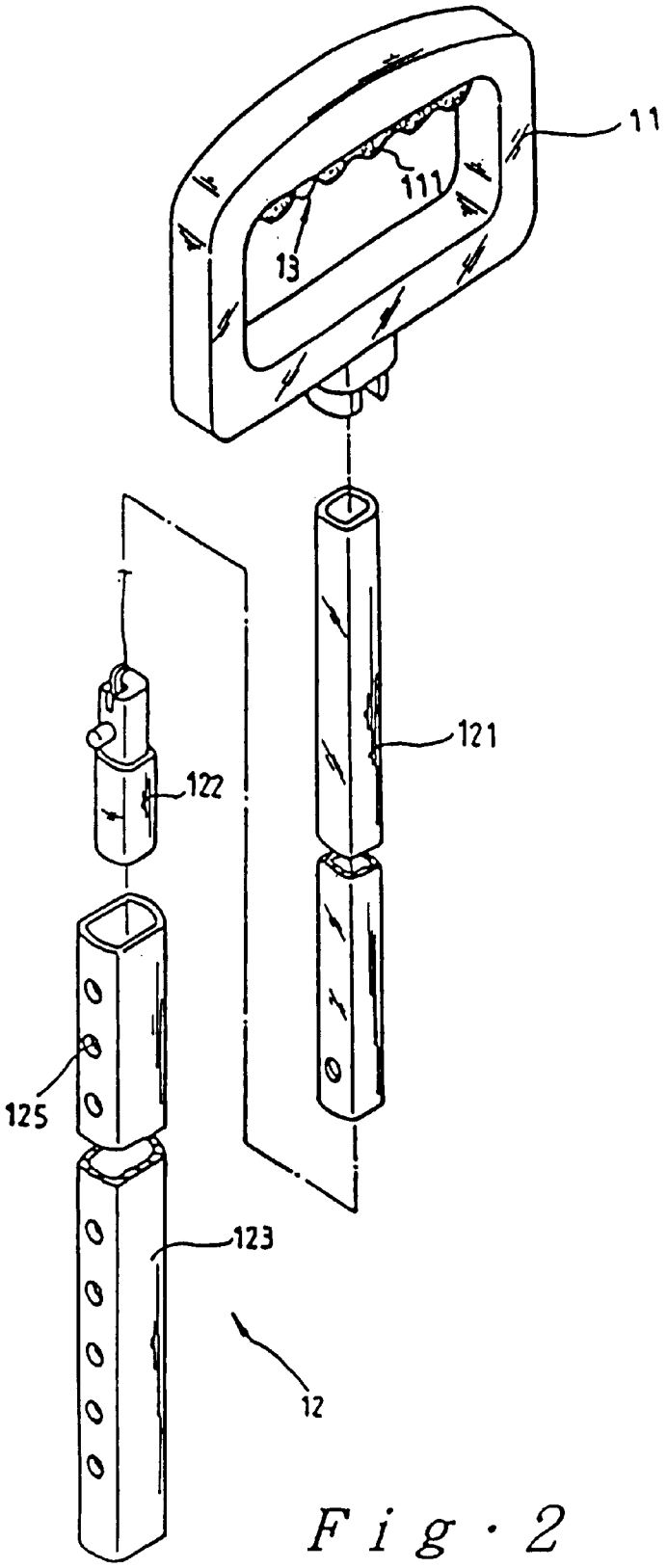
Fig. 2 PRIOR ART
FIG. 2 shows an exploded view of a pull rod of the prior art luggage.
Figure 3:
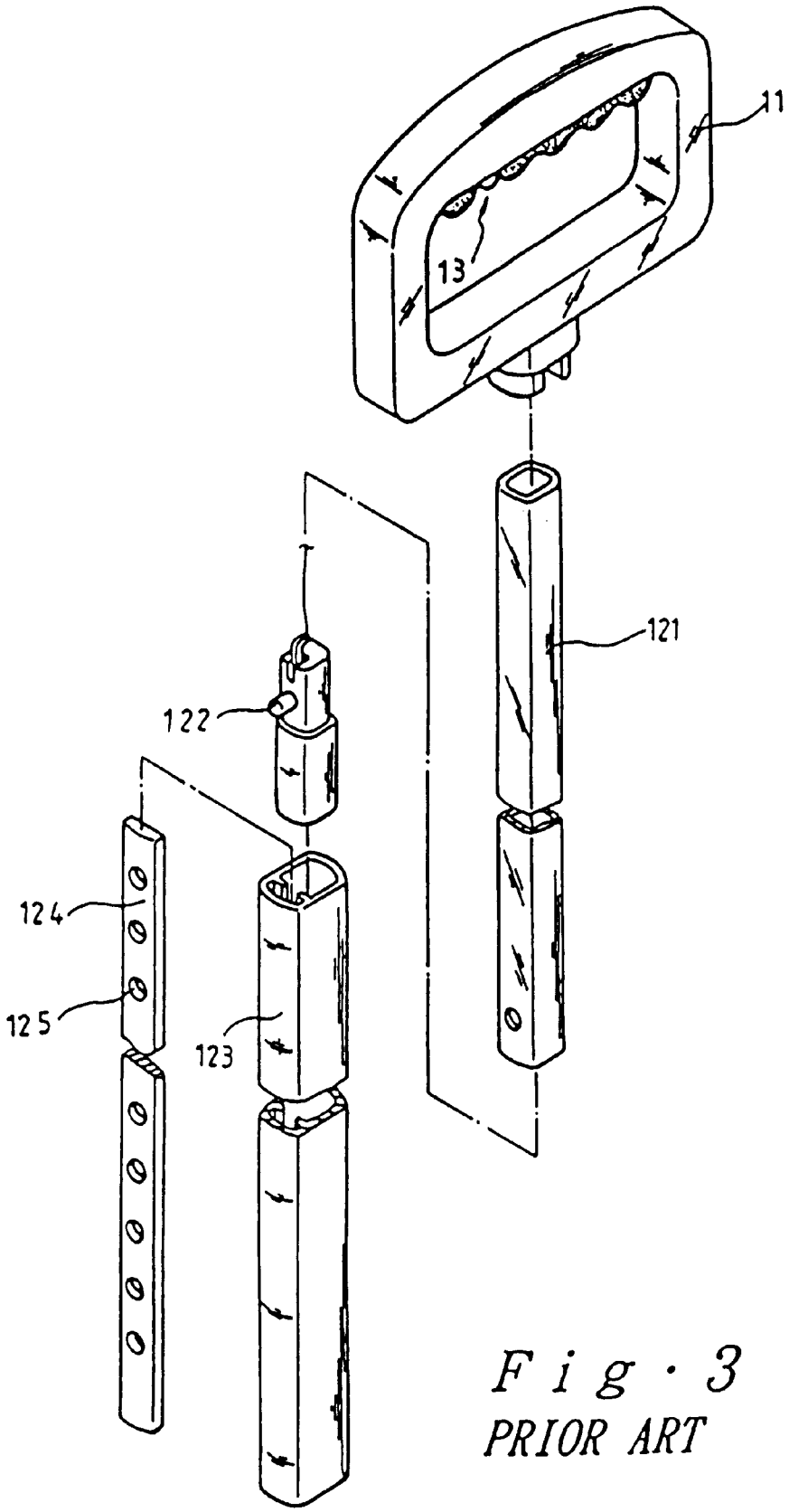
Fig. 3 PRIOR ART
FIG. 3 shows an exploded view of another pull rod of the prior art luggage.
Figure 4:
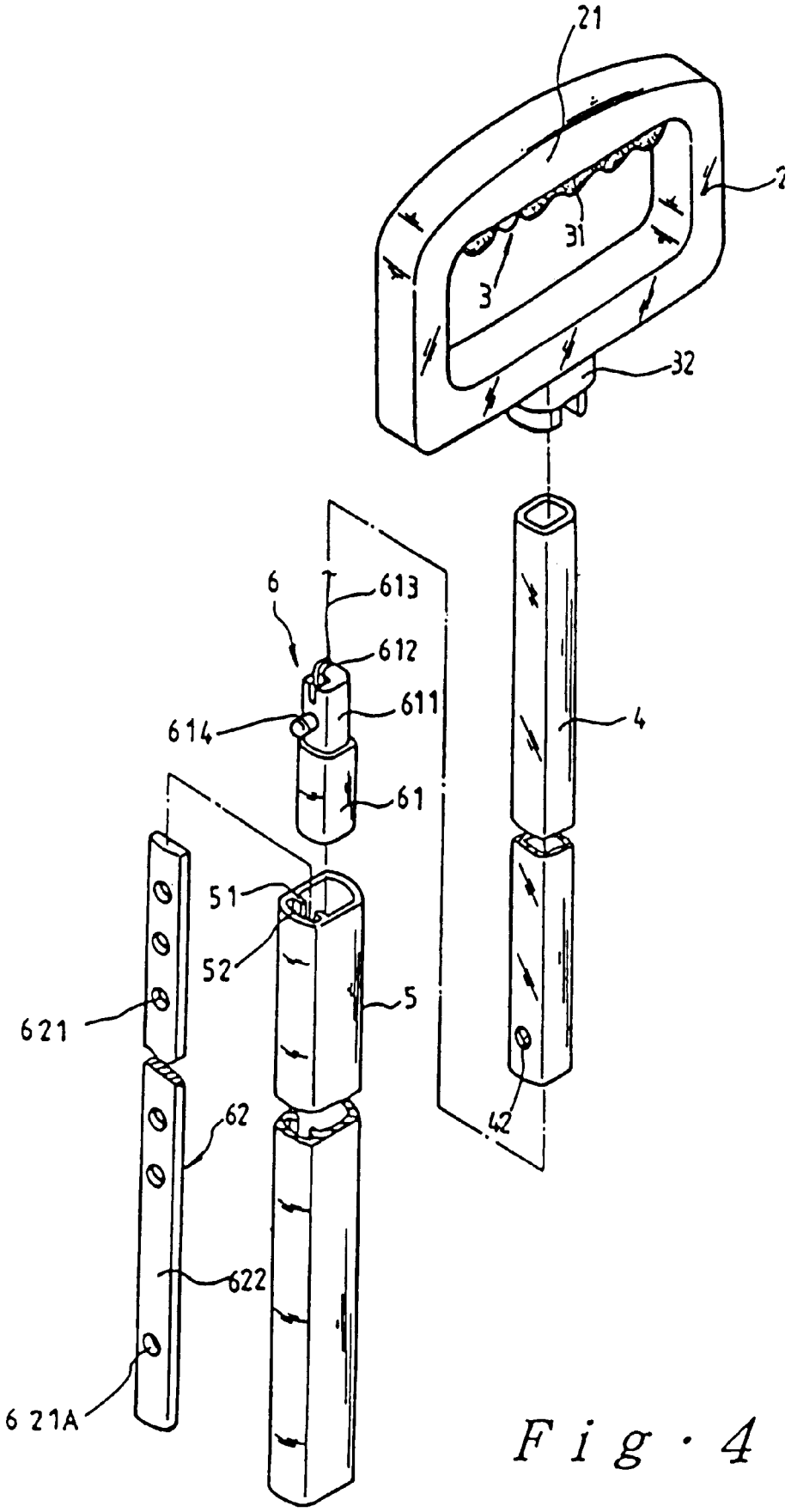
FIG. 4 shows an exploded view of a luggage pull rod of the present invention.
Figure 5:
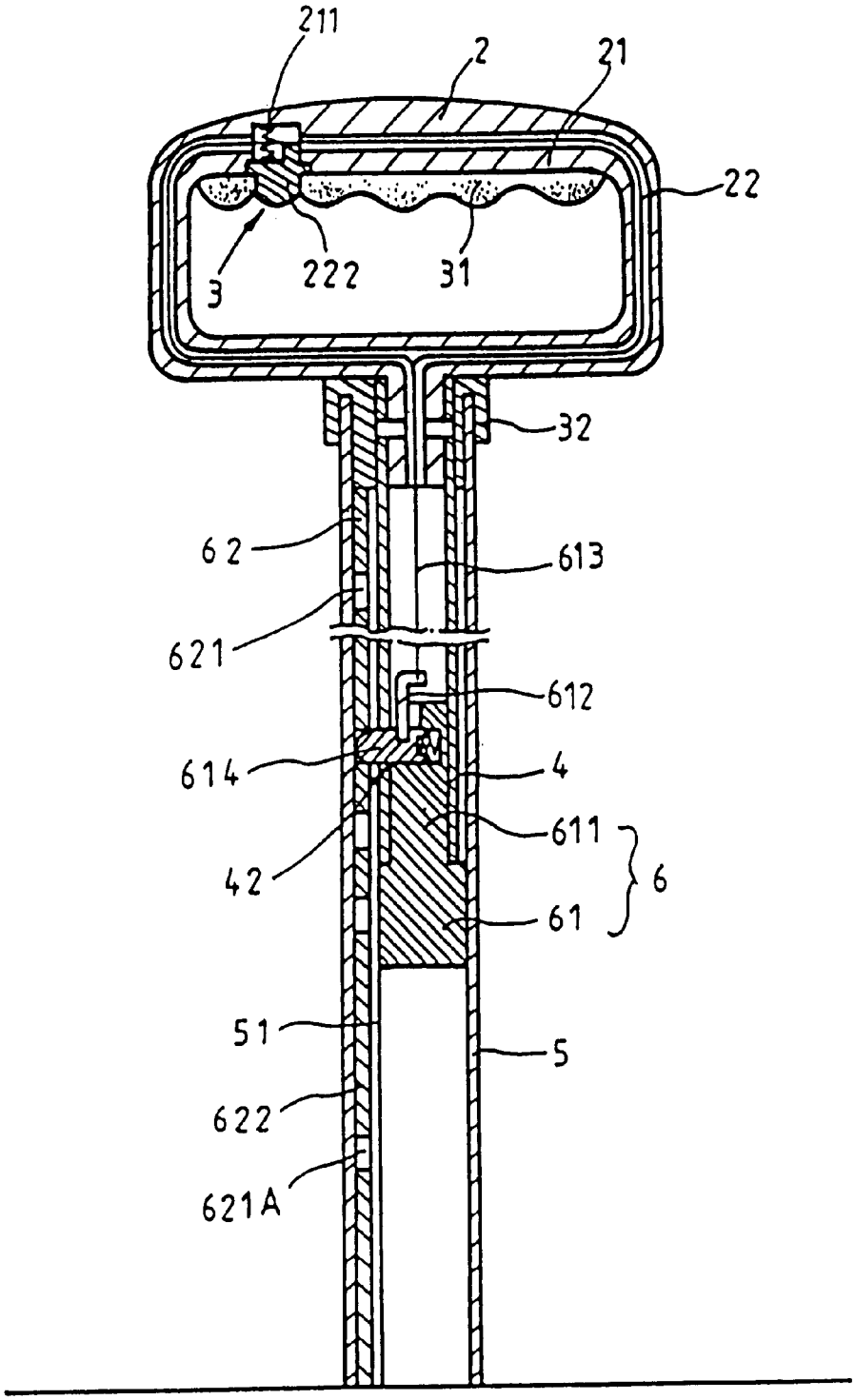
FIG. 5 shows a longitudinal sectional view of the luggage pull rod of the present invention.

As shown in FIGS. 4 and 5, a luggage pull rod embodied in the present invention is composed of a hand grip 2, an adjustment device 3, an inner tube 4, an outer tube 5, and a locating device 6.

The hand grip 2 is provided with a grip portion 21 having an actuation duct 22.

The adjustment device 3 is fastened with the hand grip 2 such that the adjustment device 3 is fastened with the grip portion 21 of the hand grip, and that a holding portion 31 of the adjustment device 3 is fastened with the grip portion 21 of the hand grip 2. FIG. 4 also shows that the retaining portion (or the bottom first locating portion) 621A is distanced from the lowest of the column of first locating portions 621 at least about twice as much as that between the equally distanced first locating portions 621. The holding portion 31 is provided with a press portion 222 having a spring 211 which is located in the actuation duct 22 of the hand grip 2.

The inner tube 4 is fastened at the top end thereof with a fastening portion 32 of the hand grip 2. The inner tube 4 is provided at the bottom end thereof with a locating hole 42. The inner tube 4 is slidably received in the outer tube 5.

The outer tube 5 is provided in the inner wall of the top end thereof with two protruded edges 51 opposite in location to each other. Located between the two protruded edges 51 is a locating space 52.

The locating device 6 is composed of an upper seat 61 which is fastened with the bottom end of the inner tube 4 and is provided with a control portion 611 having an L-shaped piece 612. The L-shaped piece 612 is connected with a pull cord 613 located in the actuation duct 22 and the inner tube 4. The locating device 6 is further provided with a first locating portion 621 and a second locating portion 614 which is engaged with the locating hole 42 of the inner tube

4. Located in the locating space 52 of the outer tube 5 is a locating element 62 which is provided with a plurality of first locating portions 621. The locating element 62 is provided at the bottom end thereof with a retaining portion 621 A. The midsegment of the locating element 62 is a smooth portion 622 devoid of the locating portions. The second locating portion 614 is jutted out of the locating hole 42 when engaged with the locating hole 42.

When the press portion 222 is pressed to actuate the pull cord 613, the L-shaped piece 612 of the locating device is actuated such that the second locating portion 614 is disengaged with the locating hole 42 of the inner tube 4, and that the second locating portion 614 is incapable of engaging the first locating portions 621 of the locating element 62. As a result, the inner tube 4 can be extracted from or retracted into the outer tube 5. As soon as the press portion 222 is relieved of an external force exerting thereon, the second locating portion 614 is engaged with one of the first locating portions 621 of the locating element 62.

Figure 6:
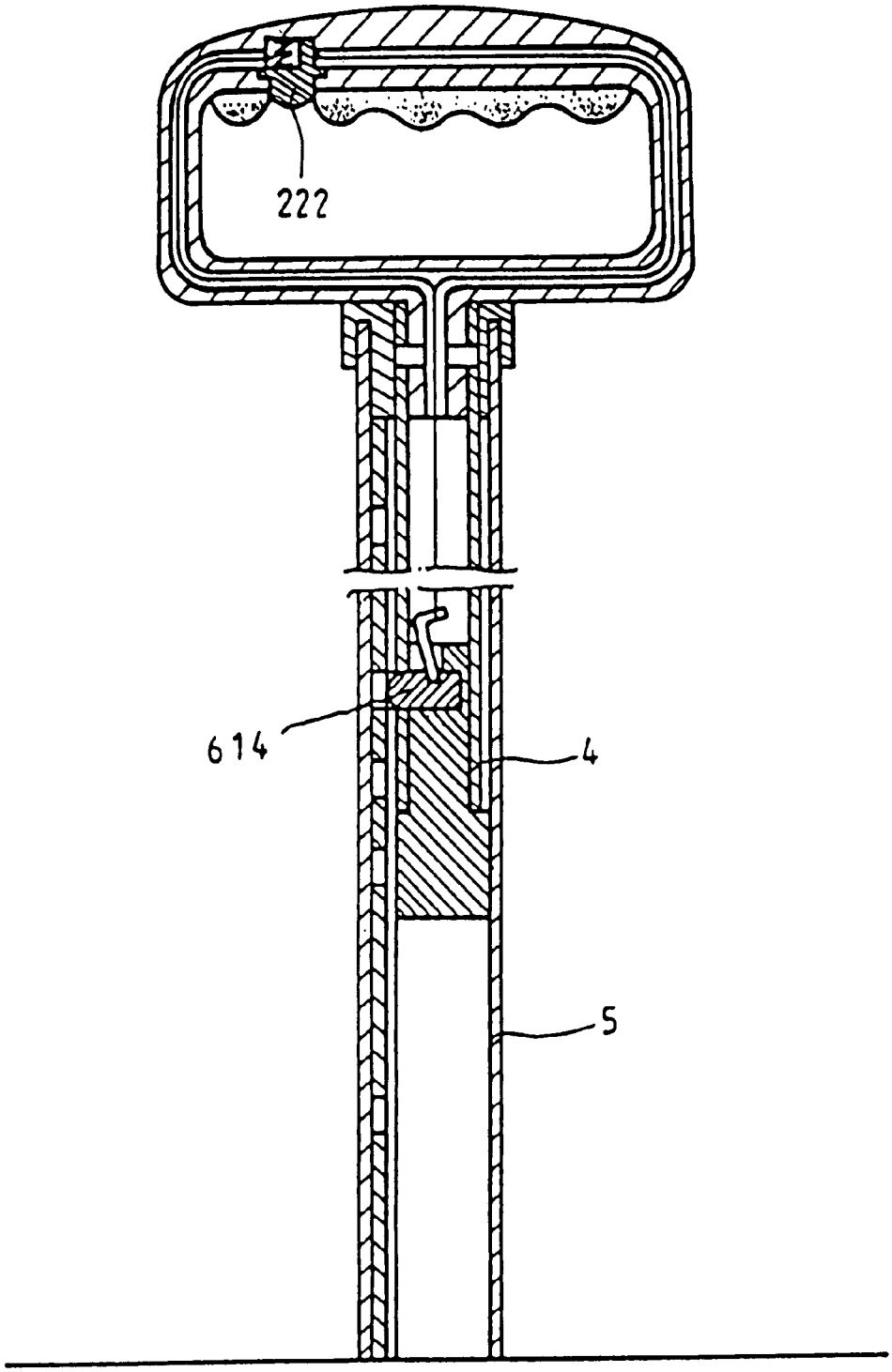
FIG. 6 is a schematic view of the luggage pull rod of the present invention at work, showing that the inner tube is about to be fully retracted into the outer tube.

As shown in FIG. 6, when the inner tube 4 is about to be fully retracted into the outer tube 5, the press portion 222 is pressed to cause the second locating portion 614 to withdraw so as to enable the inner tube 4 to be completely retracted into the outer tube 5.

Figure 7:
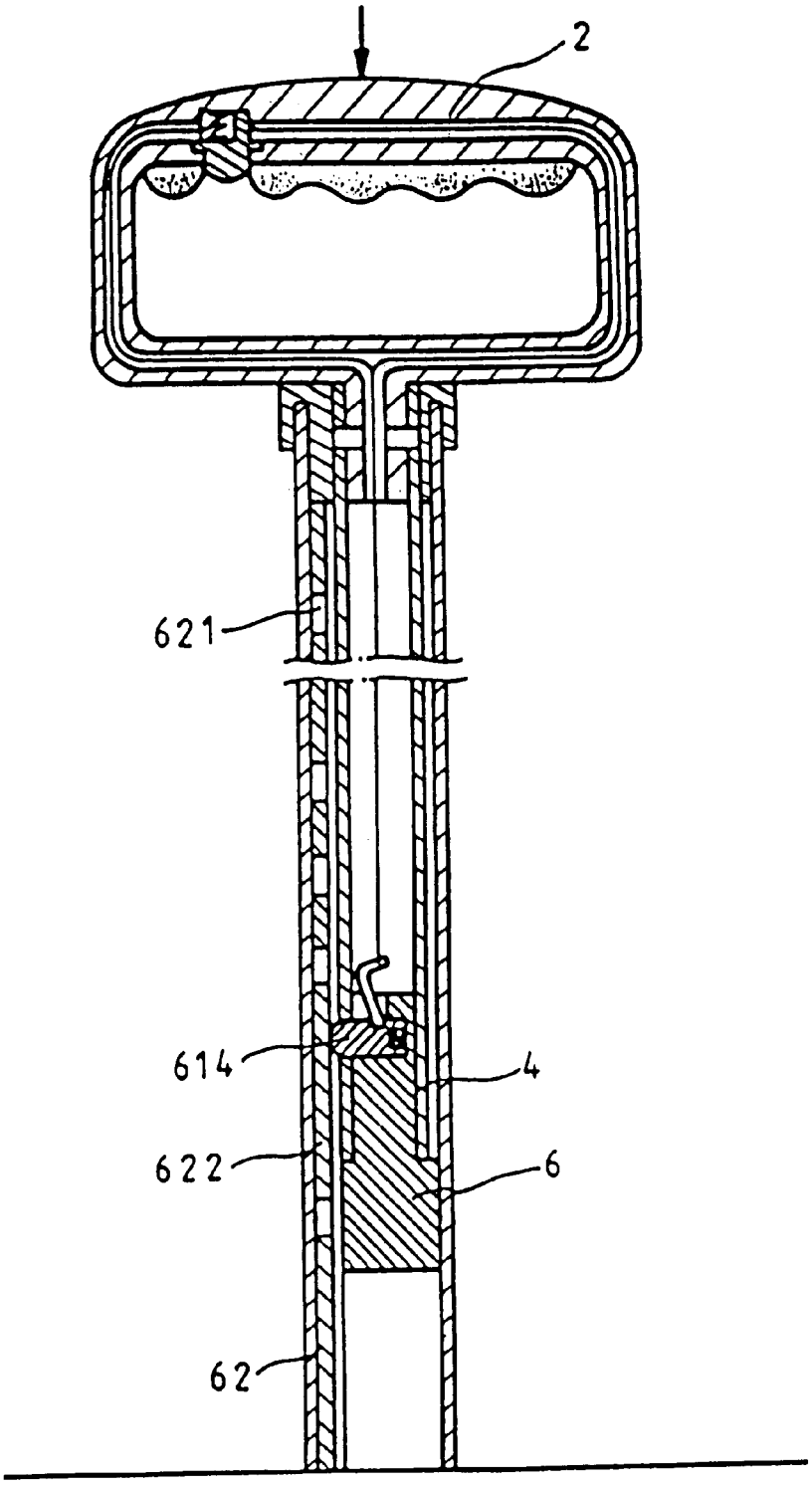
FIG. 7 is a schematic view of the luggage pull rod of the present invention at work, showing that the inner tube is retracted into the outer tube such that the second locating portion is opposite in location to the smooth portion of the locating element.
Figure 8:
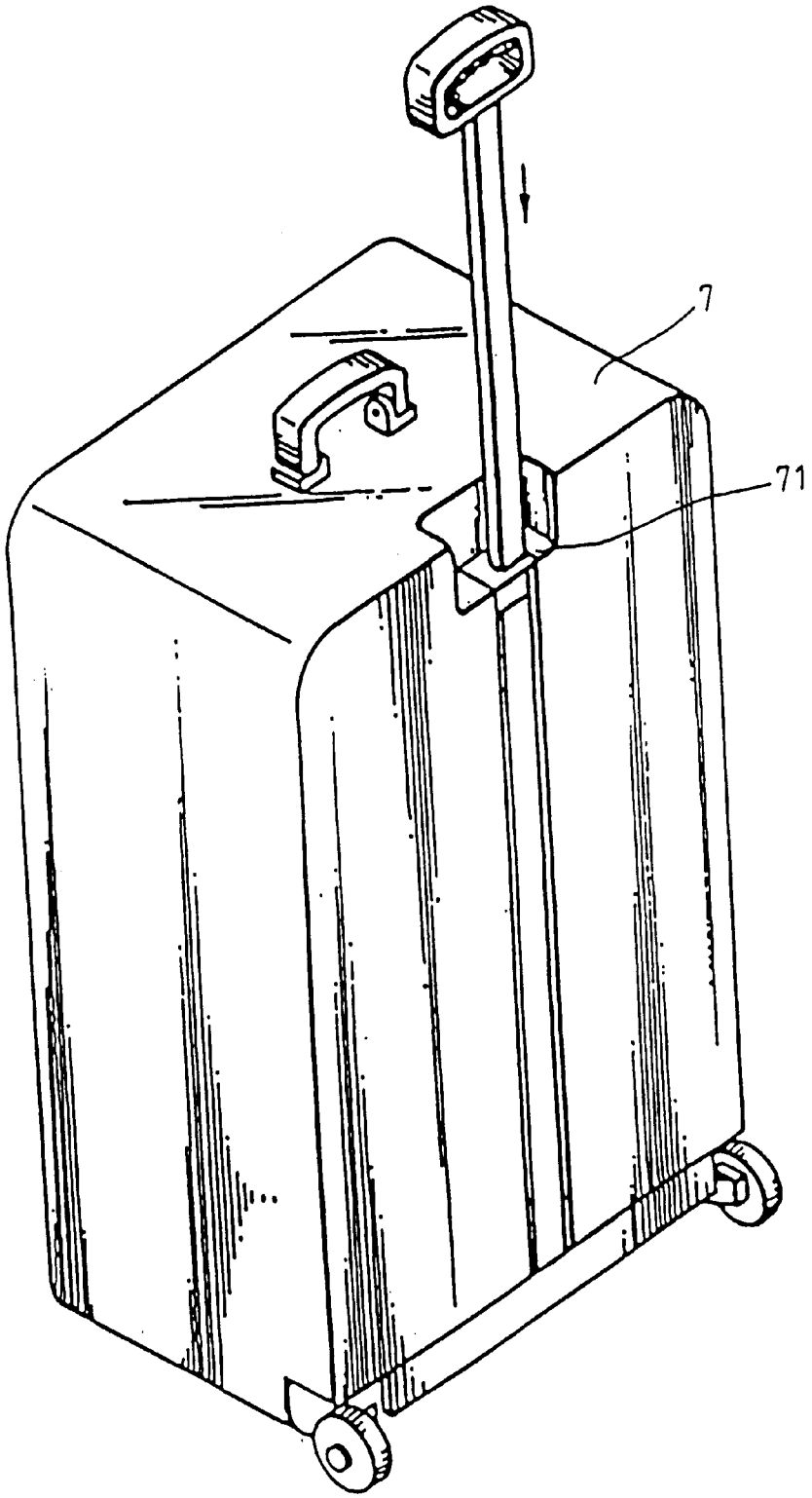
FIG. 8 is an schematic view of the luggage containing the pull rod of the present invention at work, showing that the inner tube is about to be fully retracted into the outer tube.
Figure 9:
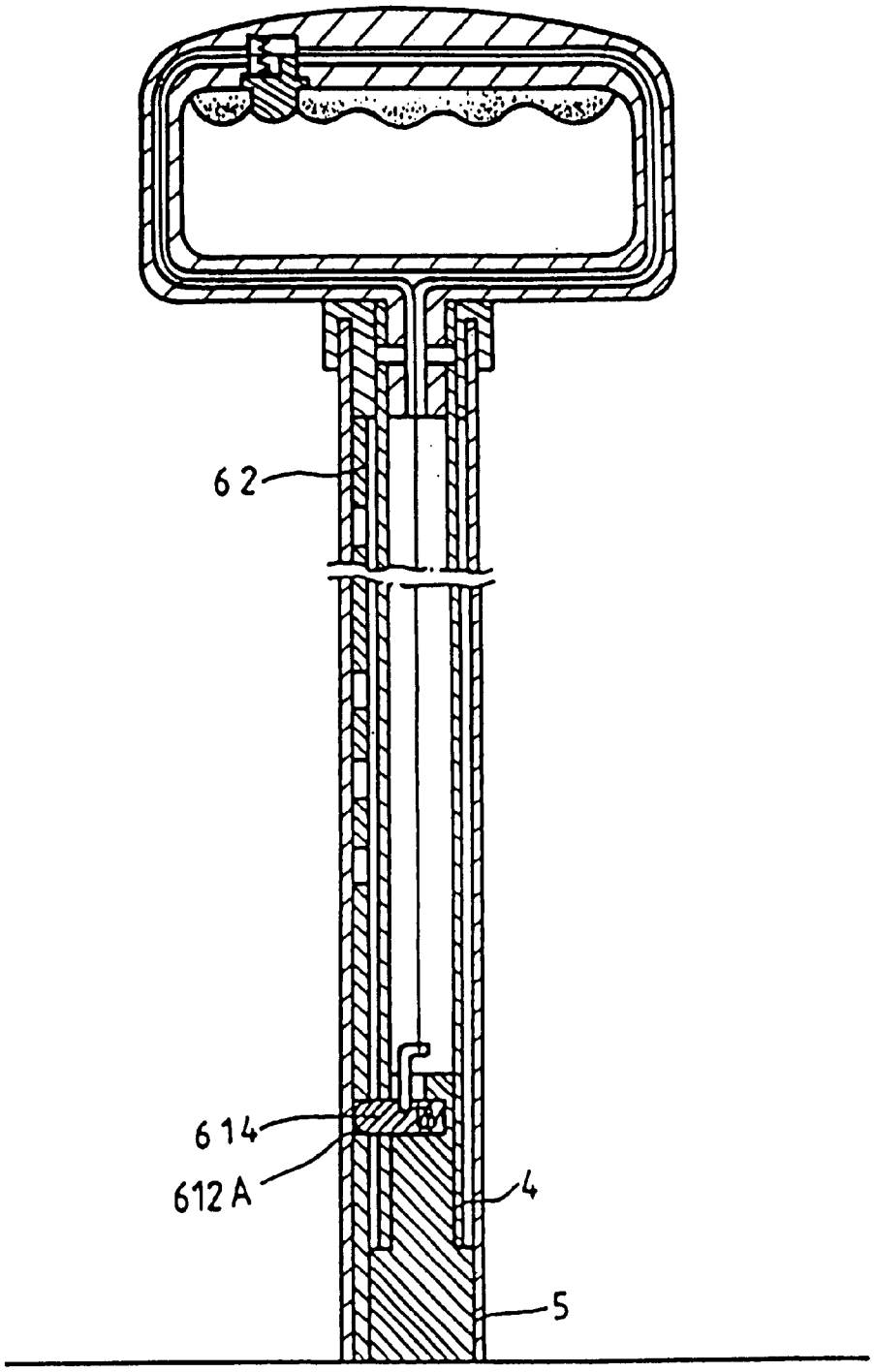
FIG. 9 is a schematic view of the luggage pull rod of the present invention at work, showing that the inner tube is forced downward by an external force so that the second locating portion is retained in the retaining portion of the locating element.
Figure 10:
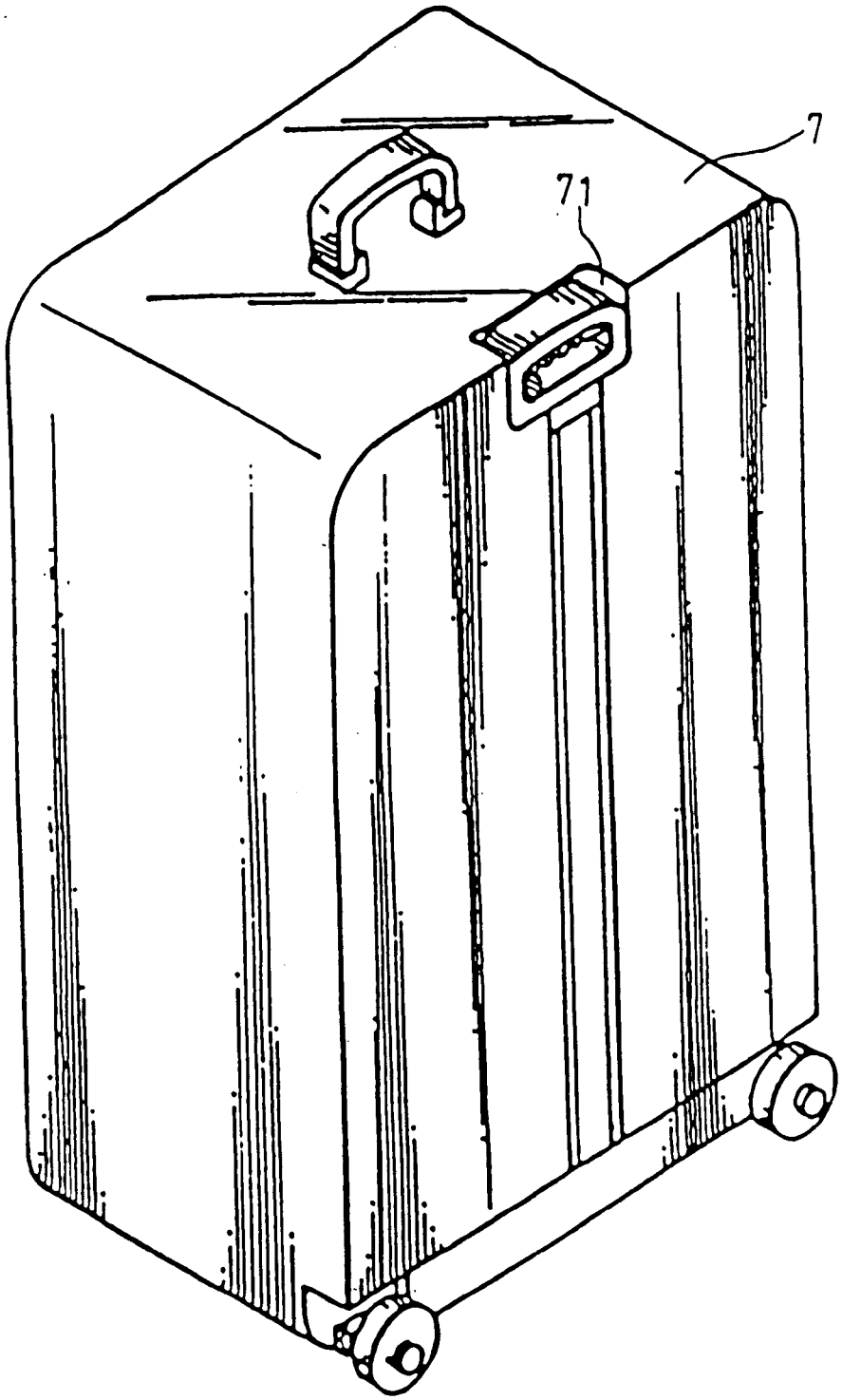
FIG. 10 is an schematic view of the luggage containing the pull rod of the present invention at work, showing that the inner tube is fully retracted into the outer tube.

As shown in FIGS. 7 and 8, when the inner tube 4 is retracted into the outer tube 5 such that the second locating portion 614 is opposite in location to the smooth portion 622 of the locating element 62, and that the hand grip 2 is lowered to be near the receiving slot 71 of the top edge 7 of the luggage. In the meantime, the inner tube 4 can be forced downward by an external force exerting on the hand grip 2 until such time when the second locating portion 614 is retained in the retaining portion 621A of the locating element 62, as illustrated in FIGS. 9 and 10.

The embodiment of the present invention described above is to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A luggage pull rod having a hand grip provided with an adjustment device capable of actuating a locating device fastened with a bottom end of an inner tube which is received extractably and retractably in an outer tube and is provided at a bottom end thereof with a locating hole;

said locating device being provided with a second locating portion engageable with said locating hole of said inner tube, said outer tube provided therein with a locating element having a plurality of first locating portions engageable with said second locating portion;

wherein said first locating portions are arranged such that they contain a bottom first locating portion and a column of substantially equally distanced first portions, and said bottom first locating portion is distanced from the lowest of said column of first locating portions at least twice as much as that between said equally distanced first locating portions.

2. The luggage pull rod as defined in claim 1, wherein said adjustment device is provided with a pull cord for actuating said locating device which is fastened with said bottom end of said inner tube.

3. The luggage pull rod as defined in claim 1, wherein said outer tube is provided therein with a locating space extending along the direction of a longitudinal axis of said outer tube; and wherein said locating element is received in said locating space of said outer tube.

4. The luggage pull rod as defined in claim 3, wherein said locating space is formed and defined by two protruded edges formed on an inner wall of said outer tube.

5. The luggage pull rod as defined in claim 1, wherein said second locating portion of said locating device is jutted out of said locating hole of said inner tube at such time when said second locating portion is engaged with said locating hole.

6. The luggage pull rod as defined in claim 1, wherein said locating element is provided at a bottom end thereof with a retaining hole engageable with said second locating portion of said locating device.

* * * * *